US010006158B2

(12) United States Patent
Okabe

(10) Patent No.: US 10,006,158 B2
(45) Date of Patent: Jun. 26, 2018

(54) SEWING MACHINE

(71) Applicant: Yamato Mishin Seizo Kabushiki Kaisha, Osaka (JP)

(72) Inventor: Masato Okabe, Osaka (JP)

(73) Assignee: Yamato Mishin Seizo Kabushiki Kaisha, Osaka (JP)

( * ) Notice: Subject to any disclaimer, the term of this patent is extended or adjusted under 35 U.S.C. 154(b) by 364 days.

(21) Appl. No.: 14/882,347

(22) Filed: Oct. 13, 2015

(65) Prior Publication Data

US 2016/0108570 A1 Apr. 21, 2016

(30) Foreign Application Priority Data

Oct. 17, 2014 (JP) ..... 2014-212891

(51) Int. Cl.
*D05B 35/02* (2006.01)
*D05B 1/18* (2006.01)

(52) U.S. Cl.
CPC ..... *D05B 35/02* (2013.01); *D05B 1/18* (2013.01)

(58) Field of Classification Search
CPC ..... D05B 35/10; D05B 35/02; D05B 35/062; D05B 29/06
See application file for complete search history.

(56) References Cited

U.S. PATENT DOCUMENTS 3,631,826 A * 1/1972 Morgan ..... D05B 35/02 112/141
5,269,239 A 12/1993 Adamski, Jr. et al.
6,192,816 B1 * 2/2001 Rovin ..... D05B 33/00 112/141
6,196,147 B1 * 3/2001 Burton ..... B22C 7/023 112/470.16

FOREIGN PATENT DOCUMENTS

EP 0621363 A1 * 10/1994 ..... D05B 33/00
JP 59-25349 Y2 7/1984
JP 07-213773 A 8/1995
JP 10-235054 A 9/1998

* cited by examiner

*Primary Examiner* — Tejash Patel
(74) *Attorney, Agent, or Firm* — Ladas & Parry, LLP

(57) ABSTRACT

Provided is a sewing machine including: a fabric folding device that includes a guide member that is movable relative to the fabric and a stationary member that is located adjacent to the guide member; and a retraction detection member that is located on a front side of the guide member and includes a pair of electric contacts that enable electric conduction by contacting with each other, the retraction detection member being configured to switch the operational state of the pair of electric contacts by abutment of a start point of a hemming seam with the retraction detection member in association with movement of the fabric in sewing the fabric. The guide member is moved by switching the operational state of the pair of electric contacts so as to retract from a path of the start point moved along with movement of the fabric.

6 Claims, 10 Drawing Sheets

SEWING MACHINE

CROSS-REFERENCE TO RELATED APPLICATION

This application claims the benefit of Japanese Patent Application No. 2014-212891, filed on Oct. 17, 2014, which is incorporated herein by reference.

BACKGROUND OF THE INVENTION

Field of the Invention

The present invention relates to a sewing machine that is capable of smoothly hemming a fabric retained in a tubular shape.

Background Art

Hitherto, as described in JP H10-235054 A, there is a sewing machine that is provided with a fabric folding device located on the front side of a needle hole. The fabric folding device includes a plate-shaped guide member that is movable in the right-left direction, a ruler member that is located on the right side of the guide member and has a curved surface corresponding to the guide member, and an air nozzle that urges a fabric by air pressure. The fabric can be folded in a gap between a right end part of the guide member and the curved surface of the ruler member by air streams ejected from the air nozzle in the state where the guide member and the ruler member are positioned close to each other with a certain distance therebetween. The folded fabric is fed to the needle hole and sewed.

When a tubular fabric (e.g., a hem or sleeve of a T-shirt, or a fabric for use in a torso portion of an undershirt) is to be hemmed using a sewing machine provided with the fabric folding device, a start point of a seam moves around a machine bed and comes into abutment with the fabric folding device as the hemming proceeds. In this regard, it is necessary to retract the guide member from the path of the start point of the seam before it comes into abutment with the fabric folding device. Otherwise, the start point of the seam may be caught or hooked by the front-side end edge of the guide member, as a result of which the fabric cannot be fed to the needle hole, and the hemming cannot proceed around the tubular shape. Accordingly, the sewing is failed and hence a sewed product becomes a rejected product.

In order to retract the guide member for avoiding such a sewing failure, a start point of the seam is optically detected in a conventional sewing machine. Although JP H10-235054 A does not specifically describe this detection, JP UM S 59-25349 B describes an optical detection in a sewing machine. Thus, the description is given with reference to JP UM S 59-25349 B. The sewing machine described in JP UM S 59-25349 B includes a combination of a phototransmitter and a photoreceiver, which is configured so that the photoreceiver receives light transmitting through the fabric, and detects that the fabric is correctly laid on each other, according to the brightness of the transmitting light received by the photoreceiver.

In a sewing machine provide with a fabric folding device like the sewing machine of JP H10-235054 A, the detection of the start point of a hemming seam is performed substantially in the same manner as above on the basis of the change in light received by the photoreceiver, which depends on whether the fabric blocks light or not. More specifically, a non-sewn portion of a fabric comes or sags down to a position between the phototransmitter and the photoreceiver and therefore blocks light, while a sewn portion of the fabric does not come or sag down to the position between the phototransmitter and the photoreceiver and therefore does not block light. Thus, the photoreceiver which starts receiving light can indirectly detect that a start point of the seam has reached a position between the phototransmitter and the photoreceiver through the detection of such sagging of the fabric, since there is a correlative relationship between the timing at which the start point of the seam has come and the timing at which the photoreceiver has started receiving light, and therefore it is assumed the start point of the seam has come.

A driving mechanism for driving the guide member is actuated upon detection of the start point of the seam to move the guide member away from the path of the start point of the seam. At the same time of detecting the start point of the seam, a counter mounted inside or outside the sewing machine starts counting the number of reciprocal motions (more specifically, the number of rotation of a main shaft of the sewing machine) and when the counted reciprocating motions reaches a certain number, a sewing operation is stopped.

However, in optical detection of the start point of the seam, the guide member can be artificially or manually retracted by, for example, an operator who lifts up the fabric located on the front side of the fabric folding device to separate the fabric from a position between the phototransmitter and the photoreceiver before the guide member is automatically retracted. Especially when the operator is skillful, he or she does such a thing in order to retract the guide member at an interval suitable in view of ease of operation. As a result, the timing at which the guide member is retracted may be varied depending on each operator, which leads to a difference in finished state of hemming among the operators. This is not preferable in view of constant sewing quality.

SUMMARY OF THE INVENTION

In view of the above problem, an object of the present invention is to provide a sewing machine that includes a guide member, the moving timing of which is not easily varied due to the human factors.

The following presents a simplified summary of the invention disclosed herein in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

According to the present invention, there is provided a sewing machine that is capable of hemming a fabric retained in a tubular shape, including: a fabric folding device that is located on a front side of a needle hole and includes a guide member that is movable relative to the fabric and a stationary member that is located adjacent to the guide member; and a retraction detection member that is located on a front side of the guide member and includes a pair of electric contacts that enable electric conduction by contacting with each other, the retraction detection member being configured to switch an operational state of the pair of electric contacts by abutment of a start point of a hemming seam with the retraction detection member in association with movement of the fabric in sewing the fabric, wherein the guide member is moved by switching the operational state of the pair of electric contacts so as to retract from a path of the start point moved along with the movement of the fabric.

The operational state of the pair of electric contacts may be switched so as to be brought into cut-off state from conduction state.

A part of the retraction detection member may be provided in the guide member.

A part of the retraction detection member may be provided on the front side of the guide member so as to be movable toward and away from the guide member.

BRIEF DESCRIPTION OF THE DRAWINGS

The foregoing and other features of the present invention will become apparent from the following description and drawings of an illustrative embodiment of the invention in which.

DETAILED DESCRIPTION OF THE PREFERRED EMBODIMENT

Now, the description is given for the present invention by taking, for example, one embodiment. It is to be noted that the directional expressions are respectively defined with reference to the operator who performs sewing, and specifically, the "front side" refers to the side close to the operator and the "back side" refers to the side far from the operator, and "upper", "lower", "right" and "left" are directions as seen from the operator who views the sewing machine.

Figure 1:
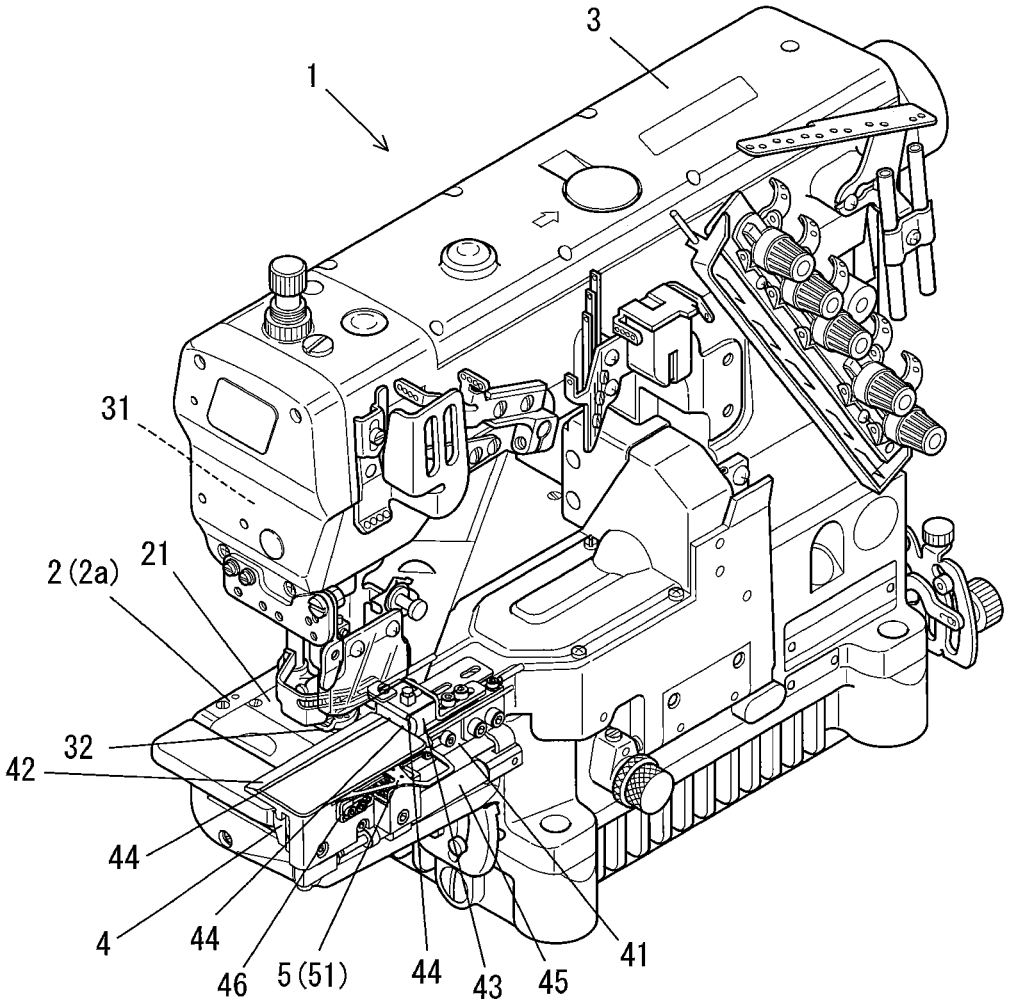
FIG. 1 is a perspective view showing a sewing machine of the present embodiment.

A sewing machine 1 of the present embodiment is a multi-needle double chainstitch machine. As shown in FIG. 1, the sewing machine 1 includes a machine bed unit 2 that is located on the lower side, and a machine arm 3 that is disposed so as to cover the machine bed unit 2 from above.

This sewing machine 1 includes a needle drive mechanism 31 mounted inside the machine arm 3 and plural needles (two or three needles in the illustrated sewing machine 1) that are aligned in the right-left direction and are reciprocatingly moved by the needle drive mechanism 31. The sewing machine 1 further includes a presser foot 32 that presses from above a fabric C to be sewn, and a stitch plate 21 that is located below the needles and secured to an upper surface of a machine bed 2*a* that is a main part of the machine bed unit 2. This stitch plate 21 has a needle hole 21*a* that is a hole through which the vertically reciprocating needles can pass. A fabric feed mechanism 22 is provided in the periphery of the needle hole 21*a*. The fabric feed mechanism 22 includes plural feed dogs (not shown) that move relative to the stitch plate 21, and can intermittently feed the fabric C pressed from above by the presser foot 32 toward the back side.

The machine bed unit 2 of the present embodiment is configured by mounting later-described fabric folding device 4 and retraction detection member 5 to the machine bed 2*a* that is a main part having a mechanism for feeding looper thread from below the fabric C in sewing. This machine bed unit 2 is a unit separately mounted from the machine arm 3, and is mountable to different types of machine arms. The machine bed 2*a* includes a looper (not shown) that feeds looper thread for forming a seam of a double chainstitch together with a needle thread passing through the needle. The machine bed 2*a* of the present embodiment is of a "cylinder bed" having a shape suitable for forming a tubular portion of a cloth (e.g., a hem or sleeve of a T-shirt, or a torso portion of an undershirt) by sewing the fabric C called "tubular material".

Figure 3:
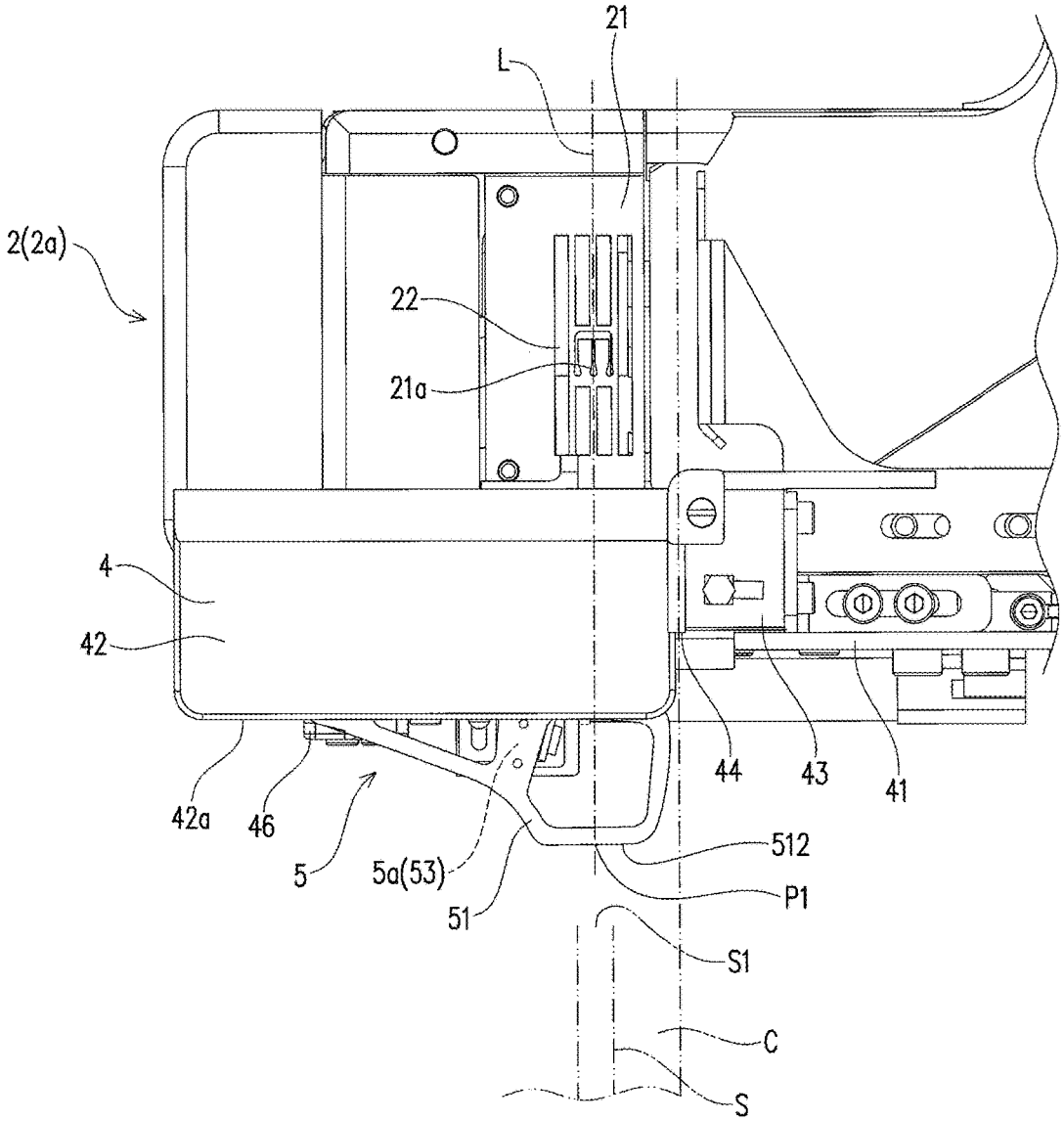
FIG. 3 is a plan view showing a periphery of the fabric folding device of the sewing machine of the present embodiment.

The fabric folding device 4 is a device for folding an end portion of the fabric C (right end portion in an example shown in a chain double-dashed line in FIG. 3) by a certain width, and includes substantially the same mechanism as that disclosed in JP H10-235054 A. The fabric folding device 4 includes a basic plate part 41 that is disposed substantially in parallel to the front side of the machine bed 2*a*. A guide member 42, a ruler member 43, and an air ejection member 44 are mounted to this basic plate part 41. Provided below the basic plate part 41 is a driving cylinder 45 for, for example, moving the guide member 42 in the fabric folding device 4. The basic plate part 41 is not essential in the present invention, and the fabric folding device 4 may be configured without providing the basic plate part 41.

Figure 4:
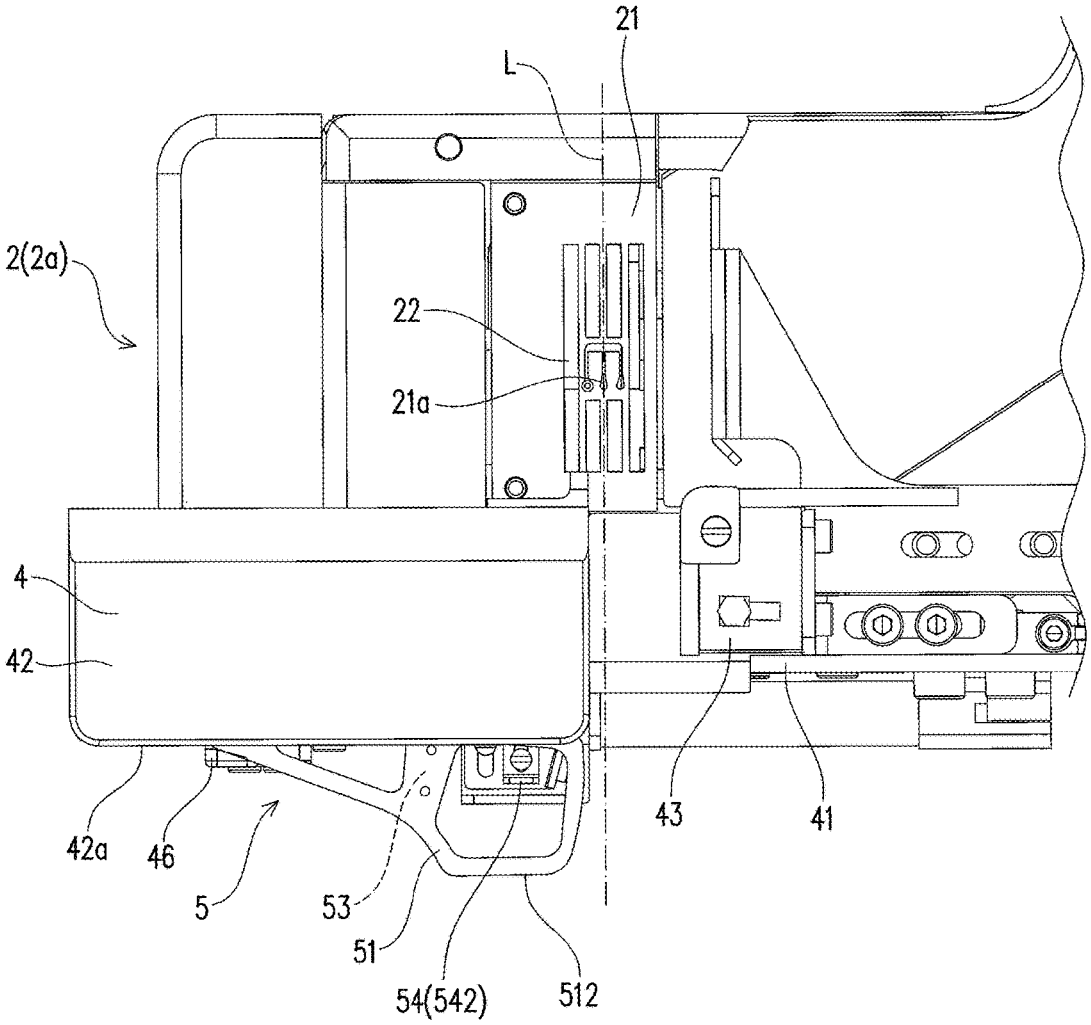
FIG. 4 is a plan view showing a periphery of the fabric folding device of the sewing machine of the present embodiment, in which the fabric folding device is in a retracted state.

The guide member 42 is capable of moving in the right-left direction by driving force of the driving cylinder 45 (FIG. 3 shows the guide member 42 which has moved in the right direction, and FIG. 4 shows the guide member 42 which has moved in the left direction). The guide member 42 has a shape shown in FIG. 2, and specifically has an upper surface 421 having a substantially rectangular flat surface as viewed in plan view. A right side part 422 of the guide member 42 has a substantially flat plate shape. The right side part 422 has a slit 423 having an opening on the front side thereof. An abutting piece 51 of the retraction detection member 5 is pivotally movably supported within the slit 423. The slit 423 is configured to allow the abutting piece 51 to be placed thereinto. An air cylinder that moves in the linear direction (right-left direction) is used in this embodiment as the driving cylinder 45, but various driving mechanisms such as a rotary cylinder can be used.

Figure 2:
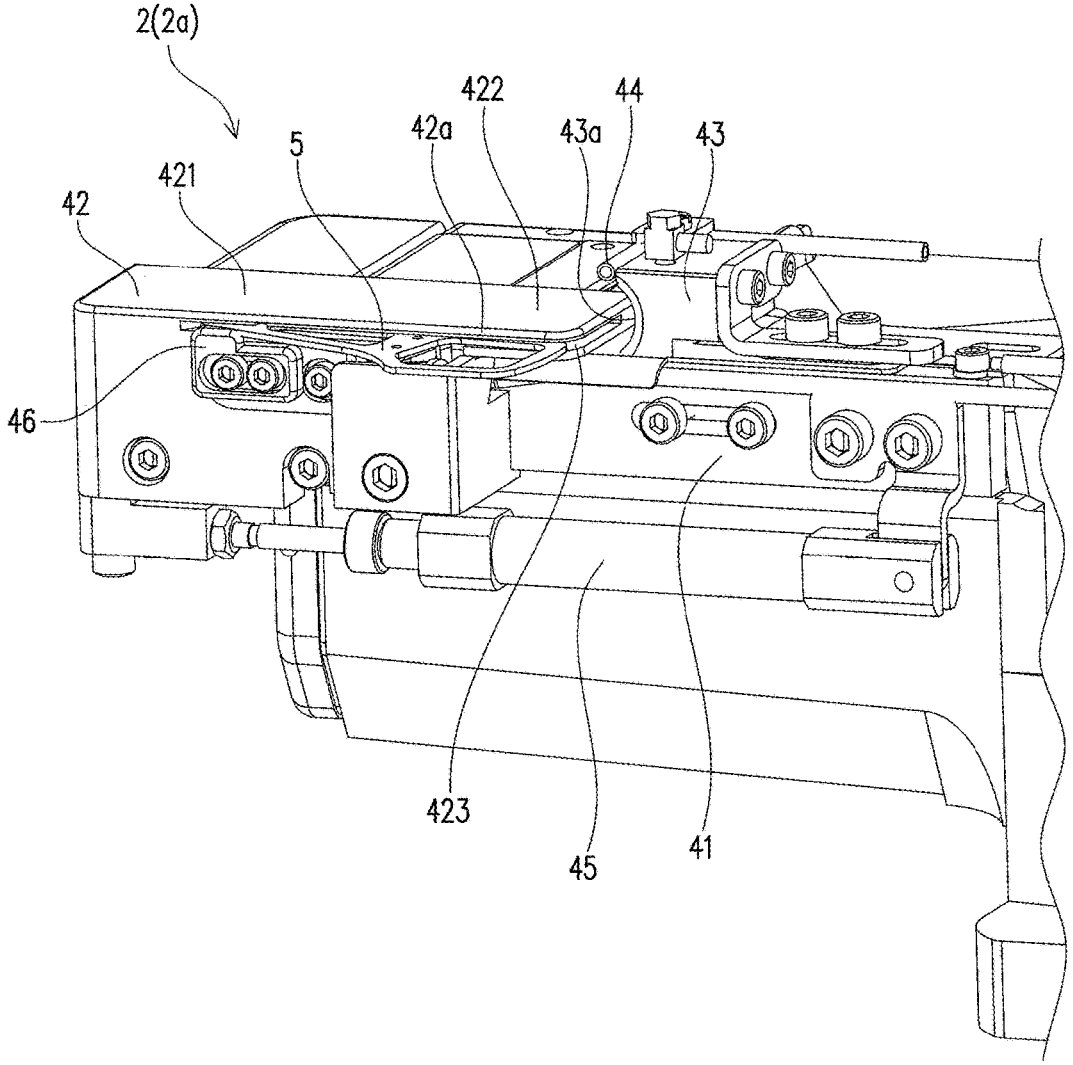
FIG. 2 is a perspective view showing a periphery of a fabric folding device of the sewing machine of the present embodiment.
Figure 5:
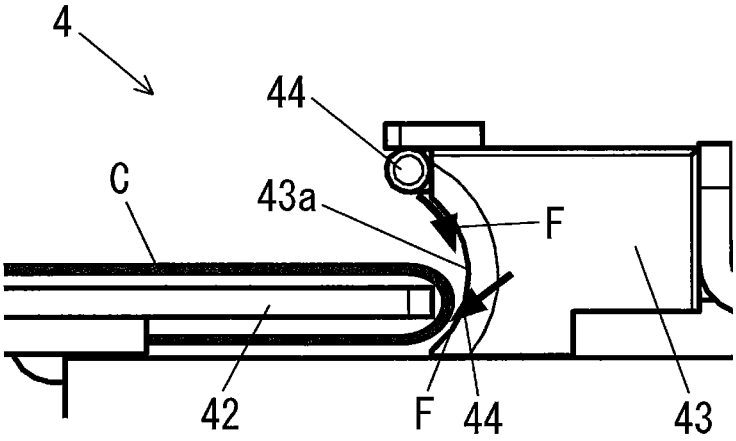
FIG. 5 is a schematic view with an enlarged main portion of the sewing machine of the present embodiment, showing the relationship between the fabric folding device and a fabric.

The ruler member 43 is a stationary part mounted to the machine bed 2*a* so as not to move at least when the fabric C is folded. The ruler member 43 is located adjacent to the guide member 42. The ruler member 43 has a block-like shape and is located on the right side of the guide member 42. The ruler member 43 has a curved surface 43*a* having a circular arc shape 43*a* on the left side. As shown in FIG. 1, the air ejection member 44 has openings at two places of the curved surface 43*a* in the front-back direction. Further, the air ejection member 44 is configured with a pipe located diagonally upward of the ruler member 43 and a leading end of the pipe facing the front side. In FIG. 1 and FIG. 2, an air conduit connected to the air ejection member 44 is omitted. As shown by an arrow in FIG. 5, an air flow F discharged from each of the openings of the air ejection member 44 causes the fabric C to move rightward on or above the guide member 42, then downward along the curved surface 43*a* of the ruler member 43, and then leftward below the guide member 42, so as to be retained in folded state. The fabric C while being retained in folded state is fed to the stitch plate 21.

Figure 6:
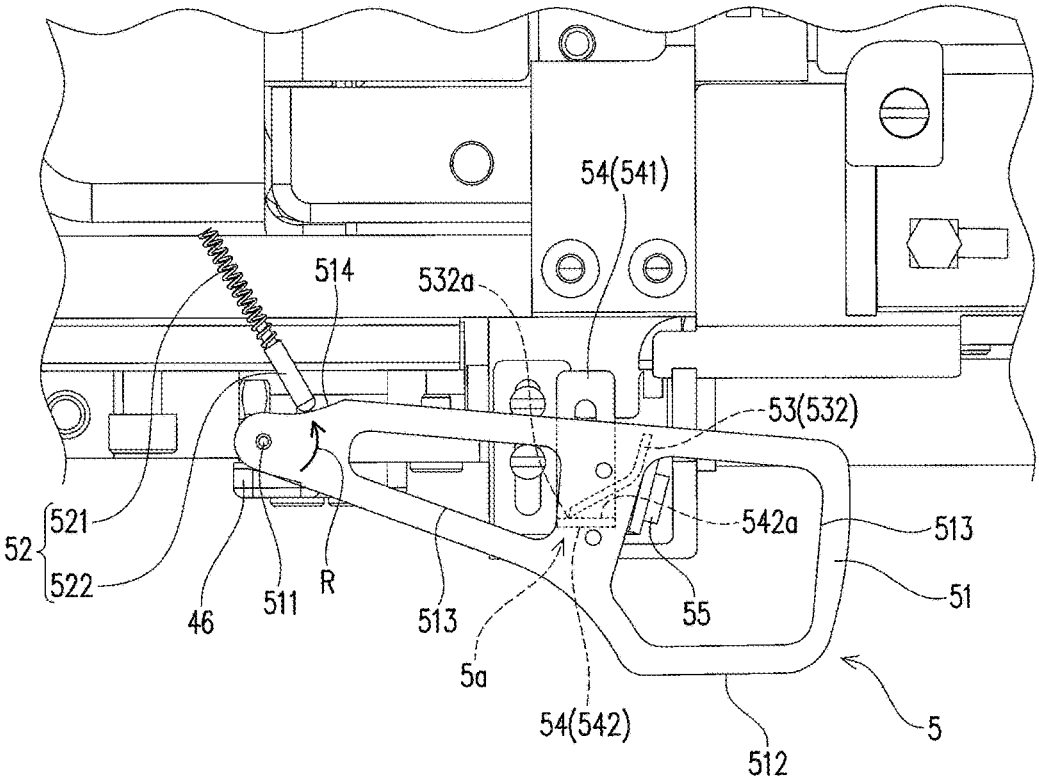
FIG. 6 is a plan view of the sewing machine of the present embodiment showing a periphery of an abutting piece with the guide member omitted.

As shown in FIG. 2 to FIG. 4, the retraction detection member 5 is located on the front side of the guide member 42. As shown in FIG. 6, the retraction detection member 5 includes an abutting piece 51, an urging member 52, and an electric contact 5*a*. In FIG. 6, the guide member 42 is omitted for explanation. The entirety of the retraction detection member 5 is not required to be located on the front side of the guide member 42. For example, the electric contact 5*a* may be located below the guide member 42, provided that a part of the retraction detection member 5 is located on the front side of the guide member 42.

The abutting piece 51 that forms a part of the retraction detection member 5 has a substantially flat plate shape. As shown in FIG. 6, the abutting piece 51 has a substantially trapezoidal shape in plan view. This abutting piece 51 is pivotally movable relative to the guide member 42 within a certain range in a virtual plane. This abutting piece 51 moves in the right-left direction along with the guide member 42. With reference to a front-side end edge 42*a* (see FIG. 2) of the guide member 42, the abutting piece 51 moves toward and away from the guide member 42 (specifically, the slit 423 formed in the guide member 42) by this pivotal motion. A slight backward motion of the the abutting piece 51 enables switching the operational state of the electric contact 5*a*, and therefore the abutting piece 51 is not required to move backward until it is completely placed inside the guide member 42, but is only required to move backward to such an extent to enable such slight backward motion. However, it is necessary that the abutting piece 51 can move backward so as not to interfere with the movement of a start point S1 of a seam S to the stitch plate 21 before the completion of retraction of the guide member 42 to the left side.

A pivotal shaft 511 is located at a left end portion of the abutting piece 51. The pivotal shaft 511 is a shaft extending in a perpendicular direction and is mounted to the guide member 42. The abutting piece 51 is pivotally movable around this pivotal shaft 511. The range within the abutting piece 51 in the state shown in FIG. 3 can be pivotally moved is determined by the urging force of the urging member 52 from the back side and the abutment between an abutting-piece-side electric contact 53 and a stationary-side electric contact 54. The range within the abutting piece 51 in the state shown in FIG. 2 and FIG. 4 can be pivotally moved is determined by the urging force of the urging member 52 from the back side and a stopper 46 mounted at a position on the front side of the guide member 42. A shape in plan view of an upper part of the stopper 46 is a substantially triangular shape (wedge shape), as shown in FIG. 6. The pivotal motion of the abutting piece 51 is regulated by the abutment with a surface of the stopper 46 corresponding to an inclined side of the substantially triangular shape. The mounting position of the stopper 46 relative to the guide member 42 is adjustable to the right side and the left side, so that the pivoting range of the abutting piece 51 is adjustable.

A lower right end edge of the abutting piece 51 as shown has a linear shape. This linear shaped part is a seam abutting part 512, and extends substantially parallel to the front-side end edge 42*a* of the guide member 42 in the state where the abutting piece 51 is positioned on the front side of the guide member 42, as shown in FIG. 3. The start point S1 of the hemming seam S abuts against a portion of the seam abutting part 512 extending from the needle hole 21*a* to the front side (a reference line L extending from the center of the needle hole 21*a* to the front side is represented in alternate long and short dash line in FIG. 3 and FIG. 4). In FIG. 3, the fabric C, the seam S (in the case where the two needles are used), and the start point S1 of the seam S are represented in alternate long and two short dashes line.

The end edge of the abutting piece 51 which extends from the left end of the seam abutting part 512 to the pivotal shaft 511 has a shape retracting backward while curving toward the left side, which shape makes it hard for the fabric C or the hand of the operator to be hooked or caught by the abutting piece 51 especially when the fabric C is set in the sewing machine 1, as compared with the abutting piece 51 which, as a whole, is located at an uniform distance to the guide member 42 on the front side. The abutting piece 51 has through openings 513 at two places for weight saving.

As shown in FIG. 6, the urging member 52 is located on the left, back side of the abutting piece 51, and includes a spring 521 and a pressing piece 522 located on the front side of the spring 521. The pressing piece 522 abuts against a spring receiving part 514 that is an end edge of the left, back side of the abutting piece 51. In the present embodiment, a coil spring that extends in the left back direction is used as the spring 521, and a rod-shaped body that is inserted into the front-side end of the spring 521 is used as the pressing piece 522.

The abutting piece 51 is urged in the clockwise direction around the pivotal shaft 511 by the urging member 52. With this configuration, when the start point S1 of the seam S comes into abutment with the abutting piece 51, the abutting piece 51 moves backward and the guide member 42 retracts (moves leftward). Whereby, the abutting piece 51 instantly retracts to the state where the abutting piece 51 is located on the front side of the guide member 42. When the guide member 42 has moved rightward, the abutting-piece-side electric contact 53 and the stationary-side electric contact 54 on the stationary side, of the electric contact 5*a* can securely come into abutment with each other by this urging.

Figure 7:
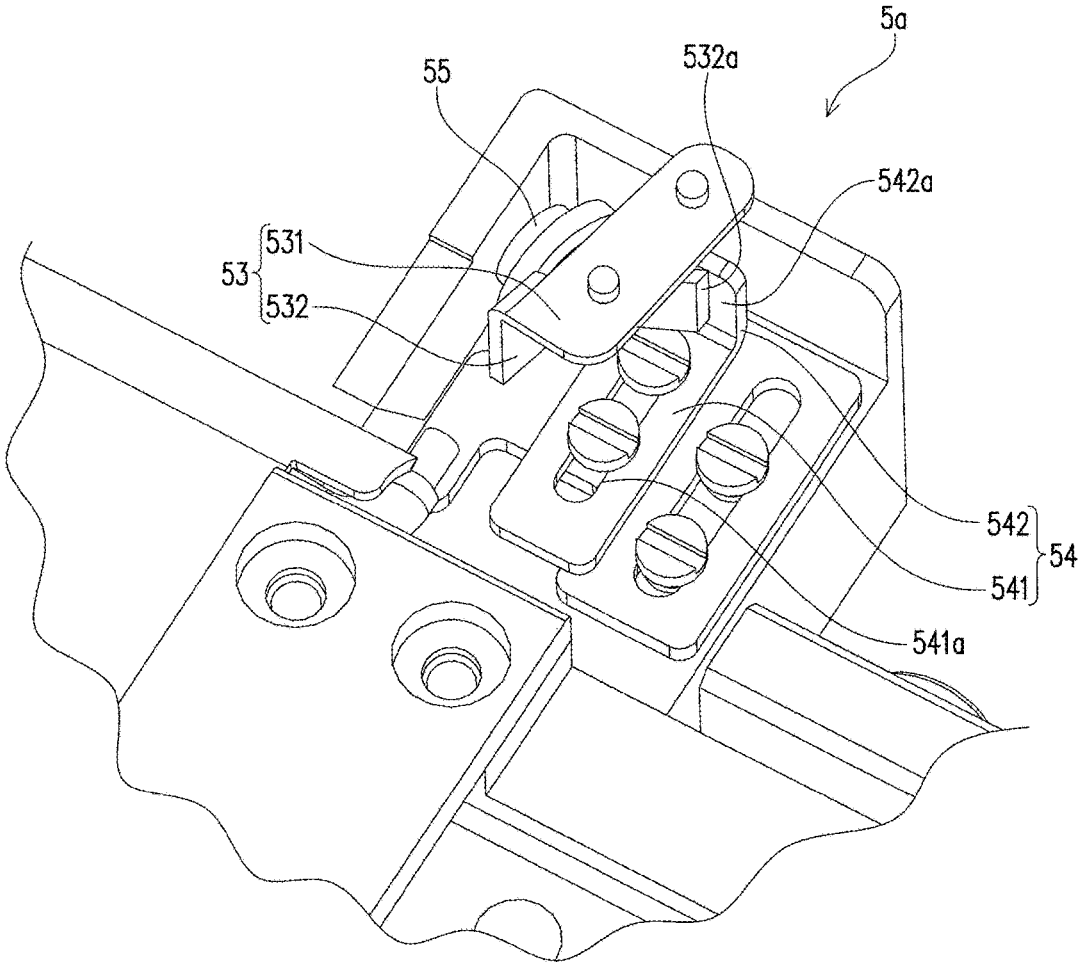
FIG. 7 is a perspective view of the sewing machine of the present embodiment, showing an electric contact as viewed from the back side with the guide member and the abutting piece omitted.

The abutting piece 51 is provided with the abutting-piece-side electric contact 53 that is a part of the electric contact 5*a* and projects from the lower surface. As shown in FIG. 7 (in FIG. 7, the abutting piece 51 is omitted for explanation), the abutting-piece-side electric contact 53 has a base part 531 to be mounted to the abutting piece 51, and a contact part 532 that extends downward from the base part 531. The contact part 532 has a substantially V shape in plan view (bottom surface view) as shown in FIG. 6. A front-side end portion 532*a* of the contact part 532 is formed with an acute angle and extends in a perpendicular direction.

A leading-end side portion of the substantially V shape of the contact part 532 extends leftward as it advances to the front side. The abutting piece 51 is urged in the clockwise direction by the urging member 52 as described above so that, when the guide member 42 moves from the left side (the position shown in FIG. 4) to the right side (the position shown in FIG. 3), the leading-end side portion of the contact part 532 can slide along a back surface 542*a* of a contact part 542 of the stationary-side electric contact 54. Thus, the electric contact 5*a* can be smoothly brought into conduction state in association with the rightward movement of the guide member 42.

Now, the description is given for the stationary-side electric contact 54 which, together with the abutting-piece-side electric contact 53, forms a pair of the electric contacts 5*a*. As shown in FIG. 7, this stationary-side electric contact 54 is located in such a manner as to be able to come into abutment with the abutting-piece-side electric contact 53. This stationary-side electric contact 54 is provided so as not to be moved relative to the machine bed 2*a*, and therefore does not move even if the guide member 42 moves.

As another embodiment of the present invention, a configuration in which the electric contacts 5*a* as a whole move leftward and rightward along with the guide member 42, for example, a configuration in which a contact corresponding to the stationary-side electric contact 54 is provided in the guide member 42, is conceivable. Even in this configuration, the electric contacts 5*a* can be brought into cut-off state in association with the backward motion of the abutting piece 51, and therefore the guide member 42 can be retracted, which retraction is triggered by that the electric contacts 5*a* have been brought into the cut-off state.

However, as compared with the configuration of the other embodiment described above, the configuration of the present embodiment is advantageous in that it does not require electric wiring connected to the electric contacts 5*a* to be configured to absorb the movement of the guide member 42 (for example, a slack arrangement of electric wiring). Further, it is not likely to cause deviated positional relationship of the electric contacts due to impact resulting from the change in acceleration when the guide member 42 moves, especially when it has finished its movement. Thus, it is possible to enable the electric contacts 5*a* to stably operate for a long period of time. Therefore, as compared to the configuration of the aforesaid other embodiment, the configuration of the present embodiment is advantageous in capability of improving the reliability of the electric contacts 5*a*. Thus, it is preferable to employ the present embodiment.

The stationary-side electric contact 54 includes a base part 541 that extends in the horizontal direction toward the front side, and a contact part 542 that erects upward in the perpendicular direction from a front-side end portion of the base part 541. The base part 541 has an elongated hole 541*a* that extends in the front-back direction, so that the position in the front-back direction of the base part 541 relative to the abutting-piece-side electric contact 53 can be adjusted by moving the base part 541 in the front-back direction, and thus the respective electric contacts 53 and 54 can be held in appropriate abutting state. The back surface 542*a* of the contact part 542 is a flat surface. The abutting-piece-side electric contact 53 comes into abutment with the back surface 542*a* to thereby bring the electric contacts 5*a* into conduction state. As shown in FIG. 7, in this conduction state, the front-side end portion 532*a* of the contact part 532 in the abutting-piece-side electric contact 53 comes in line contact with the back surface 542*a* of the contact part 542. When the abutting piece 51 pivotally moves in the direction represented by arrow R in FIG. 6, the abutting-piece-side electric contact 53 moves away from the stationary-side electric contact 54. Whereby, the electric contacts 5*a* come into cut-off state.

Thus, according to the present embodiment, the switching of the electric contacts 5*a* means the switching of the electric contacts 5*a* from the conduction state to the cut-off state. Therefore, detection can be made at the same time as the cutting-off of the electric contacts 5*a*. This is because that, if the electric contacts 5*a* are switched from the cut-off state to the conduction state, time lag is caused in detection due to the time required for the electric contacts 5*a* to achieve abutment therebetween. In the present embodiment, it is possible to reduce such time lag as low as possible, and therefore enable instant detection.

In the present embodiment, the abutting-piece-side electric contact 53 comes into line contact with the flat-shaped back surface 542*a*, and therefore response from the conduction state to the cut-off state can be made to be sharp. Thus, the guide member 42 can be instantly retracted so as not to interfere with the path of the start point S1 of the seam S to be fed backward.

The electric contacts 5*a* are configured to be physically opened and closed by the abutment between the abutting-piece-side electric contact 53 and the stationary-side electric contact 54. Therefore, a simplified structure can be realized as compared with the structure with using a sensor such as a proximity sensor or an optical sensor, and hence the likelihood of failure occurrence can be decreased. Since an industrial sewing machine required for a large amount of sewing necessitate a large number of operations of the fabric folding device 4, it is apparent that the simpler the structure is, the lower the probability in causing failure. This is a significant advantage.

In the present embodiment, the guide member 42 and the abutting piece 51 themselves constitute an electric circuit for the electric contacts 5*a*. That is, an electric current for detection flows inside the guide member 42 and the abutting piece 51. Therefore, electric wiring for forming the retraction detection member 5 can be simplified. Thus, such simplification can contribute to reduction in cost for manufacturing the sewing machines.

Figure 8:
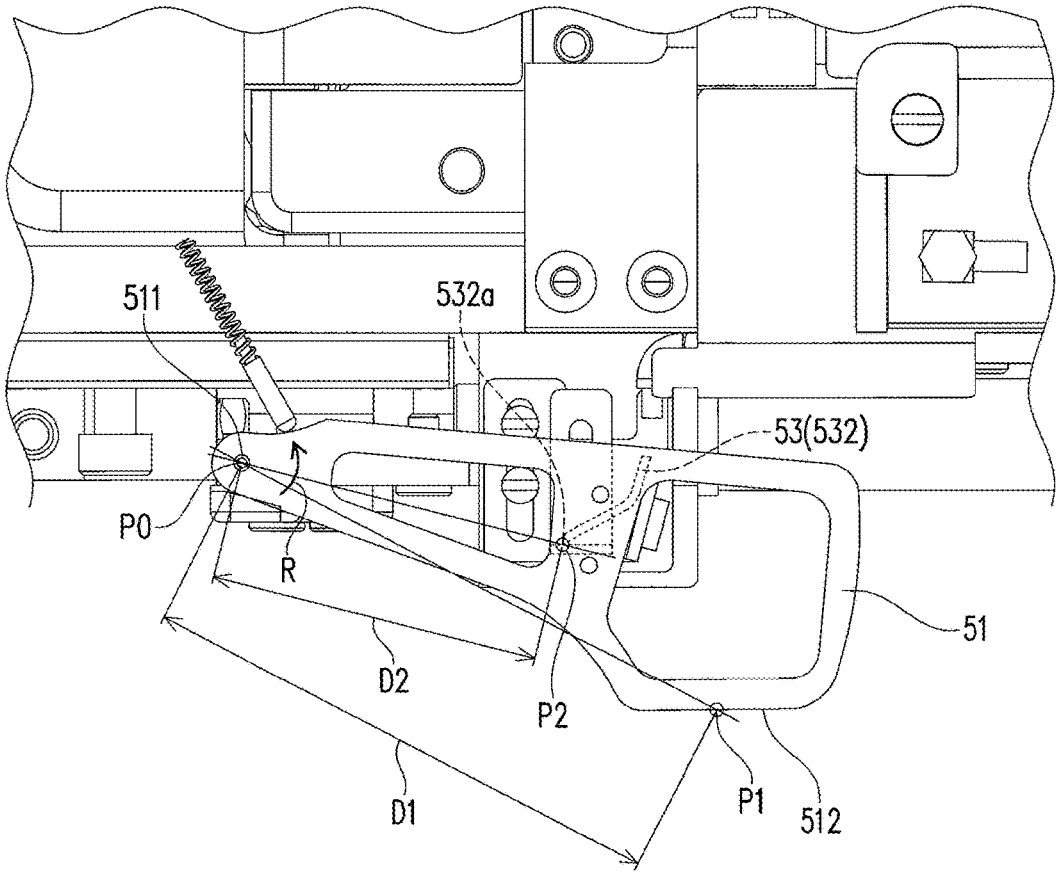
FIG. 8 is a plan view of the sewing machine of the present embodiment, showing the positional relationship between the respective portions of the abutting piece with the guide member omitted.

The abutting-piece-side electric contact 53 is located at a position close to the right end portion of the abutting piece 51. In this regard, the positional relationship in the abutting piece 51 is described with reference to FIG. 8. As shown in FIG. 8, the position of the pivotal center of the abutting piece 51 (a "fulcrum point" in a "lever") is designated as a pivotal center point PO, and the position of an intersection point of the seam abutting part 512 and the reference line L (see FIG. 3) (a "force point" in a "lever") is designated as a seam abutting point P1. A contact point in plan view (an "operating point" in a "lever") between the back surface 542*a* of the contact part 542 in the stationary-side electric contact 54 and the front-side end portion 532*a* of the contact part 532 in the abutting-piece-side electric contact 53 is designated as an electric contact point P2. In the present embodiment, the electric contact point P2 of the abutting piece 51 is set at a position closer to the seam abutting point P1 than to the pivotal center point PO. A linear distance D2 Between the pivotal center point PO and the electric contact point P2 is set to be larger than ½th of the linear distance D1 between the pivotal center point PO and the seam abutting point P1.

In the abutting piece 51 of the present embodiment, as shown in FIG. 8, the pivotal center point PO, the electric contact point P2, and the seam abutting point P1 are aligned in this order in the radial direction with reference to the pivotal shaft 511. The alignment of the respective points may be so that, for example, the electric contact point P2, the pivotal center point PO, and the seam abutting point P1 are aligned in this order. However, the configuration of the present embodiment, in which the two points are aligned along a line extending in the same direction from the pivotal center point PO, increases the possibility of reducing the size of the abutting piece 51, as compared with the configuration in which the two points are aligned with the pivotal center point PO therebetween.

Thus, with the configuration in which the position of the electric contact point P2 in the abutting piece 51 is set to be close to the seam abutting point P1, it is possible to approximate the moving distance (pivotal movement distance) of the seam abutting point P1 and the moving distance (pivotal movement distance) of the electric contact point P2 to each other at the time of pivotal movement of the abutting piece 51. Thus, when the start point S1 of the seam S has come into abutment with the abutting piece 51, it is possible to increase the moving distance of the front-side end portion 532*a* of the contact part 532 of the abutting-piece-side electric contact 53 away from the back surface 542*a* of the contact part 542 of the stationary-side electric contact 54 in the pivotal movement of the abutting piece 51. Therefore, as compared with the configuration in which the position of the electric contact point P2 is relatively far from the seam abutting point P1 in the movement (pivotal movement) of the abutting piece 51 in the direction represented by the arrow R, it is possible to clearly distinguish between disturbance or noise affected on the retraction detection member 5, such as vibrations of the sewing machine 1, and the backward movement of the abutting piece 51 which should necessarily cause the retraction of the guide member 42, by appropriately setting the threshold value for the detection. Thus, it is possible to accurately detect the abutment of the start point S1 of the seam S with the abutting piece 51 and suppress or prevent erroneous detection by providing the abutting-piece-side electric contact 53 at a position close to the right end portion of the abutting piece 51.

Further, a permanent magnet 55 is mounted to the stationary-side electric contact 54. The permanent magnet 55 in the state as shown in FIG. 6 attracts the abutting-piece-side electric contact 53 that is formed by a magnetic substance. Attraction by this magnetic force can suppress or prevent the electric contacts 5*a* from being erroneously cut off due to the factor other than the pivotal movement of the abutting piece 51, such as vibrations from the outside. Urging by the urging member 52 and attraction of the abutting-piece-side electric contact 53 by the permanent magnet 55 act together to enable the abutting piece 51 to instantly return to the state where it is located on the front side of the guide member 42, when the guide member 42 is to be retracted by the backward movement of the abutting piece 51 caused by the abutment of the start point S1 of the seam S. Further, the spring constant of the spring 521 of the urging member 52 can be reduced by the amount compensated by the urging force of the magnetic force of the permanent magnet 55. Specifically, the spring constant can be set at a minimum value for returning the abutting piece 51 to the initial state where the abutting piece 51 is located on the front side of the guide member 42. Because of this, the resistance force applied from the abutting piece 51 supported by the spring due to the abutment of the fabric C to the abutting piece 51 can be reduced, so that it is possible to suppress or prevent the finished state of the hemming from being influenced by the abutment of the fabric C with the abutting piece 51. Further, the manufacturing cost can be reduced as compared with the case where the spring 521 of a large spring constant is used. Still further, the abutting piece 51 can be easily mounted to the retraction detection member 5 since the spring force is weak.

Although not illustrated, it may be configured such that a device (e.g., a nozzle) for ejecting air to the electric contacts 5*a* (especially between the electric contacts 53 and 54) is provided. With this configuration, the ejected air blows off yarn waste or dust, thereby enabling suppression or prevention of occurrence of conduction failure due to adhesion of such yarn waste or dust onto the electric contacts 5*a*.

According to the thus configured retraction detection member 5, the abutting piece 51 moves backward by the abutment of the start point S1 of the seam S. The backward direction of the abutting piece 51 coincides with the moving direction of the fabric C. Thus, the configuration for detecting the start point S1 of the seam S can be simplified. Since the electric contacts 5*a* can be switched from the conduction state to the cut-off state only by the movement of the retraction detection member 5, it is not necessary to interpose another member for switching the operational state of the electric contacts 5*a* (a member for causing delay in response) between the abutting piece 51 and the electric contacts 5*a*, and therefore a response of the electric contacts 5*a* can be made to be sharp.

Figure 9:
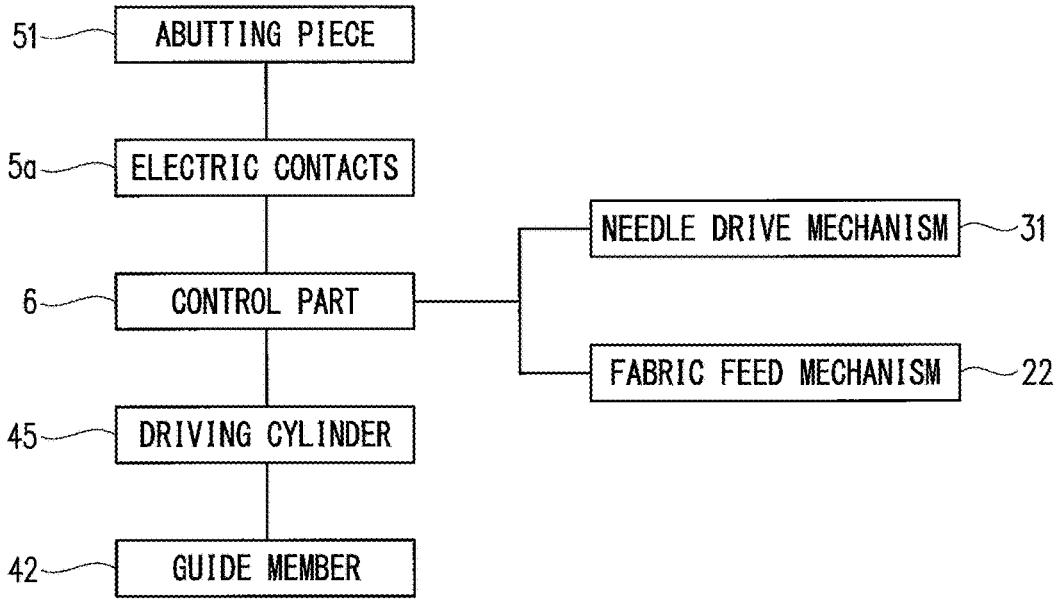
FIG. 9 is a block diagram relating to a section associated with the fabric folding device and a retraction detection member of the sewing machine of the present embodiment.

The cut-off of the electric contacts 5*a* can be detected by a control part 6 (see FIG. 9). The control part 6 may be located inside the sewing machine 1 or outside the sewing machine 1. The control part 6 enables the guide member 42 to move leftward by actuating the driving cylinder 45, and retract from the path of the start point S1 of the seam S which moves backward. Since the guide member 42 moves leftward, the guide member 42 does not interfere with the start point S1 of the seam S of the fabric C by the leftward movement of the region of the guide member 42 located on the right side of the reference line L, as seen from FIG. 3 and FIG. 4. Thus, the retraction can be achieved in a short time. This retraction therefore prevents hooking or catching of the start point S1 of the seam S by the front-side end edge of the guide member 42 and enables hemming around the tubular shape of the fabric C.

In the present embodiment, the guide member 42 is retracted by the physical change, that is, abutment of the start point S1 with the retraction detection member 5. Thus, it is possible to reduce the likelihood of occurrence of fluctuation in retraction timing of the guide member 5 due to the human factor, as compared with the prior configuration where the start point of the seam is optically detected. Thus, it is possible to suppress or prevent variations in finished state of the hemming due to different operators. This contributes to constant quality of sewing products. Since the retraction detection member 5 moves along with the guide member 42 when in retracting, the retraction detection member 5 does not interfere with the path of the start point S1 of the seam S.

The control part 6 controls the needle drive mechanism 31 and the fabric feed mechanism 22 so that a counter (not shown) within the control part 6 starts counting the number of reciprocating motions of the needle (more specifically, the rotational number of the main shaft of the sewing machine) at the same time when the start point S1 of the seam S has come into abutment with the abutting piece 51 and hence the electric contacts 5*a* have come into the cut-off state, and the control part 6 stops the sewing operation (reciprocating motions of the needle and the feeding of the fabric), when a certain number of reciprocating motions is counted. Whereby, sewing can be finished with a certain length of superimposed sewing.

Figure 10:
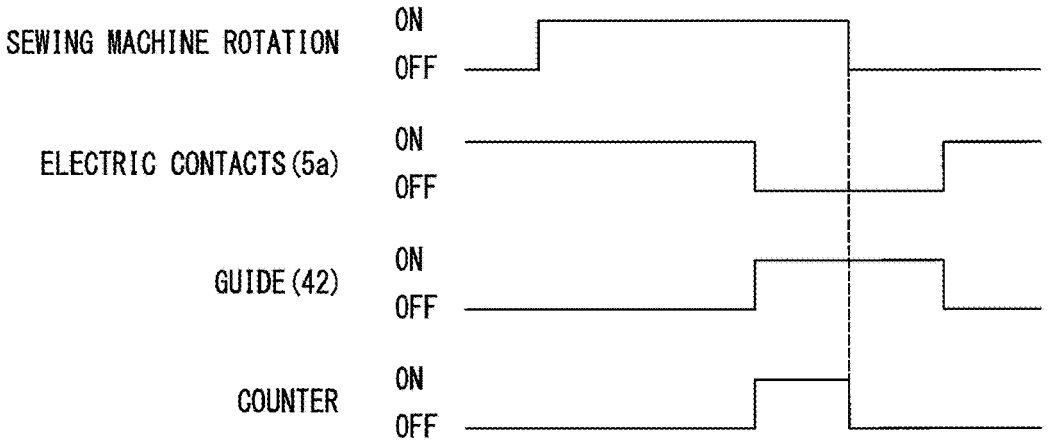
FIG. 10 is a timing chart showing the motion of a portion associated with the fabric folding device and the retraction detection member of the sewing machine of the present embodiment.

FIG. 10 shows the timing chart. The start point S1 of the seam S of the fabric C comes into abutment with the abutting piece 51 during the rotation of the main shaft of the sewing machine (the "SEWING MACHINE ROTATION" on the first line in FIG. 10 is in the "ON" state), so that the electric contacts 5*a* come into the cut-off state (the "ELECTRIC CONTACTS (5*a*)" on the second line in FIG. 10 comes into the "OFF" state from the "ON" state). Thereupon, the control part 6 actuates the driving cylinder 45 to move the guide member 42 leftward (the "GUIDE (42)" on the third line in FIG. 10 comes into the "ON" state from the "OFF" state). Then, the counter starts counting (the "COUNTER" on the fourth line in FIG. 10 comes into the "ON" state from the "OFF" state). The counter finishes counting after a certain number is counted (the "COUNTER" on the fourth line in FIG. 10 comes into the "OFF" state), and the control part 6 stops the rotation of the main shaft of the sewing machine (the "SEWING MACHINE ROTATION" on the first line in FIG. 10 comes into the "OFF" state). Thereafter, the guide member 42 returns to the right side (the "GUIDE (42)" on the third line comes into the "OFF" state), and at the same time, the electric contacts 5*a* return to the conduction state (the state enabling electric conduction) (the "ELECTRIC CONTACTS (5*a*)" on the second line in FIG. 10 comes into the "ON" state.

Although the description was given for the embodiments of the present invention, the present invention is not necessarily limited to those embodiments, but may be subjected to various modifications within the scope of the gist of the present invention.

For example, the abutting piece 51 may not have a flat plate shape, but a three dimensional shape, such as a T shape or an L shape located on the front side of the guide member. Further, in addition to the above embodiments in which the abutting piece 51 is pivotally movably mounted to the guide member 42, the abutting piece 51 as a whole may be supported to the guide member 42, for example, in a slidingly movable manner in the front-back direction. Further, the abutting piece 51 may be provided separately from the guide member 42. In the above embodiments, the pivotal shaft 511 and the abutting-piece-side electric contact 53, which are separately formed from each other, are mounted to the abutting piece 51. However, these members may be integrally formed. Still further, in the above embodiments, the seam abutting part 512 has a linear shape, but the present invention is not necessarily limited to this, and the seam abutting part 512 may have a curved shape. In such a curved shape, it may be configured such that the convex side faces the front side, or reversely, the concave side faces the front side.

The electric contacts 5*a* of the above embodiments are composed of a portion on the moving side (front-side end portion 532*a* of the contact part 532) having an acuate shape with an acute angle, and a portion on the stationary side (back surface 542*a* of the contact part 542) having a plane shape, but the relationship of the shapes of these members may be reversed. Further, the back surface 542*a* of the contact part 542 of the above embodiments is a flat surface orthogonal to the front-back direction, but may be an inclined surface relative to the front-back direction, as long as it does not interfere with the retraction of the guide member 42 and the abutting piece 51. Still further, the back surface 542*a* may not only be a flat surface, but also be a curved surface. The electric contacts 5*a* of the above embodiments comes into the conduction state through line contact, but may be through point contact. Further, the retraction detection member 5 of the aforesaid embodiments is provided with a pair of the electric contacts 5*a*, but as long as at least one pair of the electric contacts 5*a* is provided, two or more pairs of the electric contacts 5*a* may be provided.

The sewing machine 1 of the above embodiments is a multi-needle double chainstitch machine, but the retraction detection member 5 can be provided in sewing machines of various sewing methods.

Lastly, the configurations of the embodiments and the functions produced by these configurations are summarized as below.

In the present embodiment, there is provided the sewing machine 1 that is capable of hemming the fabric C retained in a tubular shape, including: the fabric folding device 4 that is located on the front side of the needle hole 21*a* and includes the guide member 42 that is movable relative to the fabric C and the ruler member 43 that is located adjacent to the guide member 42; and the retraction detection member 5 that is located on the front side of the guide member 42 and includes a pair of electric contacts 5*a* that enable electric conduction by contacting with each other, the retraction detection member 5 being configured to switch an operational state of the pair of electric contacts 5*a* by abutment of the start point S1 of the hemming seam S with the retraction detection member 5 in association with movement of the fabric C in sewing the fabric, wherein the guide member 42 is moved by switching the operational state of the pair of electric contacts 5*a* so as to retract from a path of the start point S1 moved along with the movement of the fabric C.

According to the above configuration, the retraction of the guide member 42 is achieved by physical change, that is, abutment of the start point S1 of the seam S with the retraction detection member 5. It is possible to suppress or prevent the retraction of the guide member 42 due to the human factor by the operator, as compared with the prior configuration where the start point of the seam is optically detected. Thus, it is possible to suppress or prevent the likelihood of occurrence of fluctuation in retraction timing of the guide member.

The operational state of the pair of electric contacts 5*a* may be switched so as to be brought into cut-off state from conduction state.

According to the above configuration, it is possible to detect abutment of the start point S1 of the seam S with the retraction detection member 5 at the same time as cutting off of the pair of electric contacts 5*a*. If the switching is made so as to be brought into conduction state from cut-off state, time lag is caused in detection due to the time required for the electric contacts 5*a* to come into abutment with each other. However, the above configuration can eliminate such time lag.

A part of the retraction detection member 5 may be provided in the guide member 42.

According to the above configuration, the part of the retraction detection member 5 moves along with the guide member 42 at the time of retraction, and therefore the retraction detection member 5 does not interfere with the start point S1 of the seam S due to, for example, delay in movement of the retraction detection member 5.

A part of the retraction detection member 5 may be provided on the front side of the guide member 42 so as to be movable toward and away from the guide member 42.

According to the above configuration, which enables the part of the retraction detection member 5 to be moved backward in a direction matching the moving direction of the fabric C at the time of sewing. Further, since the operational state of the electric contacts 5*a* is switchable only by the backward movement of the part of the retraction detection member 5, the response of the electric contacts 5*a* is sharp.

The sewing machine of the present embodiments is as described above. However, the present invention is not limited to the aforementioned embodiments, and the design can be appropriately modified within the scope intended by the present invention. The operational advantage of the present invention is also not limited to the foregoing embodiments. The embodiments disclosed herein should be construed in all respects as illustrative but not limiting. The scope of the present invention is not indicated by the foregoing description but by the scope of the claims. Further, the scope of the present invention is intended to include all the modifications equivalent in the sense and the scope to the scope of the claims.

What is claimed is:

1. A sewing machine that is capable of hemming a fabric retained in a tubular shape, comprising:

a fabric folding device that is located on a front side of a needle hole and includes a guide member that is movable relative to the fabric and a stationary member that is located adjacent to the guide member; and a retraction detection member that is located on a front side of the guide member and includes a pair of electric contacts that are held in a conduction state when they are in contact with each other and held in a cut-off state when they are away from each other, the retraction detection member being configured to switch the pair of electric contacts from the conduction state to the cut-off state or vice versa by abutment of a start point of a hemming seam with the retraction detection member in association with movement of the fabric in sewing the fabric, wherein the guide member is moved by switching an operational state of the pair of electric contacts so as to retract from a path of the start point moved along with movement of the fabric.

2. The sewing machine according to claim 1, wherein the operational state of the pair of electric contacts is switched into the cut-off state from the conduction state.

3. The sewing machine according to claim 1, wherein a part of the retraction detection member is provided in the guide member.

4. The sewing machine according to claim 3, wherein a part of the retraction detection member is provided on the front side of the guide member so as to be movable toward and away from the guide member.

5. The sewing machine according to claim 2, wherein a part of the retraction detection member is provided in the guide member.

6. The sewing machine according to claim 5, wherein a part of the retraction detection member is provided on the front side of the guide member so as to be movable toward and away from the guide member.

* * * * *